US007341174B1

(12) United States Patent
Wen

(10) Patent No.: US 7,341,174 B1
(45) Date of Patent: Mar. 11, 2008

(54) PNEUMATIC NAIL GUN

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/614,071

(22) Filed: Dec. 20, 2006

(30) Foreign Application Priority Data

Oct. 30, 2006 (TW) ..... 95140022 A

(51) Int. Cl.
*B25C 1/04* (2006.01)

(52) U.S. Cl. ..... 227/130; 227/8

(58) Field of Classification Search ..... 227/130, 227/8; 123/46 SC; 173/210, 212
See application file for complete search history.

(56) References Cited

U.S. PATENT DOCUMENTS 4,294,391 A 10/1981 Obergfell
4,319,705 A 3/1982 Geist et al.
4,784,308 A 11/1988 Novak et al.
5,135,152 A * 8/1992 Uno et al. ..... 227/116
5,441,192 A * 8/1995 Sugita et al. ..... 227/130
5,485,946 A * 1/1996 Jankel ..... 227/8
5,873,510 A * 2/1999 Hirai et al. ..... 227/130
5,911,351 A * 6/1999 White ..... 227/130
6,006,975 A * 12/1999 Ishizawa ..... 227/119
6,260,519 B1 * 7/2001 Phillips ..... 123/46 R
6,533,156 B1 * 3/2003 Chang ..... 227/130
6,779,699 B2 * 8/2004 Aoki et al. ..... 227/130

* cited by examiner

*Primary Examiner*—Scott A. Smith

(57) ABSTRACT

A pneumatic nail gun includes a gun body having a movable cylinder therein; a hitting piston disposed in the cylinder; a main air housing collecting a compressed high pressure air with a constant pressure; and at least one main passage disposed at a peripheral portion of the cylinder or a side of the main air housing, the at least one main passage having a valve bolt therein to divide the main passage into a top passage, a middle valve chamber, and a bottom passage, the top passage and the middle valve chamber being connecting with the main air housing for introducing and gathering high pressure air therein, the middle valve chamber being connecting with the bottom passage via the main valve opening, the valve bolt being capable of controlling the opening and closing of the main valve opening for rapidly repositing the piston.

12 Claims, 10 Drawing Sheets

PNEUMATIC NAIL GUN

BACKGROUND

The present invention relates to pneumatic nail guns, and particularly to a pneumatic nail gun having a movable cylinder for a hitting piston of the nail gun driven by the high pressure air to upwardly move for reposition and a head valve disposed on top of the movable cylinder.

A typical pneumatic nail gun has a gun body, a main air housing formed in the gun body to continuously collect the compressed high pressure air for nail hitting, a movable or fixed cylinder disposed in the gun body, and a hitting piston installed inside the cylinder and divided the cylinder into a top and a bottom cylinder chambers. Moreover, a trigger disposed on the gun body may be pressed to have the high pressure air guided into the top cylinder chamber to drive the piston downwardly move for hitting the nails, and be released to have the high pressure air discharged from the top cylinder chamber and guided into the bottom cylinder chamber to upwardly move the piston for reposition.

The related arts, such as U.S. Pat. No. 4,784,308, U.S. Pat. No. 4,319,705 and U.S. Pat. No. 4,294,391 respectively disclose a pneumatic nail gun having the movable cylinder and the head valve individually disposed on top of the movable cylinder. The head valve can push the cylinder moving downwardly and move upwardly together with the cylinder. When the trigger is pressed, the high pressure air in the main air housing can drive the head valve upwardly move together with the cylinder to open a bottom passage for air discharging in the bottom cylinder chamber and open the passage between the head valve and the cylinder to guide the high pressure air into the top cylinder chamber for driving the piston move downwardly. When the trigger is released, the cylinder moves downwardly together with the head valve to open a top passage for air discharging in the top cylinder chamber so that the piston can move upwardly to reposit. However, since the head valve is separated from the cylinder, in order to effectively control the head valve and the cylinder moving together, not only a passage for moving the head valve has to be formed in the gun body, but also a passage for the high pressure air moving the cylinder has to be formed in the main air housing. As such, the nail gun has a high manufacturing cost and complicated air flow passage distribution.

Above related arts also disclose to utilize a valve control device between the main air housing and the bottom cylinder chamber to control the timing of the high pressure air driving the piston move upwardly to reposit; therefore, as the trigger is released, the valve control device can open the passage between the main air housing and the bottom cylinder chamber so that the high pressure air can be continuously introduced to the bottom cylinder chamber to move the piston upwardly for reposition. However, the valve control device has complicate assembly and more passages in the nail gun are needed, as well as the valve control device is installed farther away from the cylinder in the gun body so that larger capacity of gun body and higher cost are inevitable.

Accordingly, what is needed is a pneumatic nail gun that can overcome the above-described deficiencies.

BRIEF SUMMARY

A pneumatic nail gun of the present invention improves the air flow passage distribution for the compressed high pressure air driving the piston upwardly move to reposit and simplifies the valve controlling mechanism required by the distribution; therefore, the manufacturing cost can be reduced.

The present invention is to provide a pneumatic nail gun includes a gun body, a main air housing, a main passage, a top through hole, a bottom through hole and a main valve. The gun body has a movable cylinder installed therein, a head valve integrally formed or disposed on the top of the cylinder, a hitting piston disposed in the cylinder to divide the cylinder into a top cylinder chamber and a bottom cylinder chamber. The main air housing accumulates continuously supplied compressed air at a high pressure to drive the hitting piston downwardly move to hit nails and upwardly move to reposit. The main passage is formed at a peripheral portion or a side of the movable cylinder, and includes a valve bolt installed therein to divide the main passage into a top passage, a middle valve chamber, and a bottom passage. The top through hole is connected between the top passage and the main air housing to guide the high pressure air into the top passage for accumulation. The bottom through hole is connected between the middle valve chamber and the main air housing to guide the high pressure air into the middle valve chamber for accumulation. The main valve opening is formed between the middle valve chamber and the bottom passage to be opened or closed under the controlling of the valve bolt. Before the piston hitting the nails, the high pressure air in the top passage drives the valve bolt downwardly move to close the main valve opening so that air communication between the middle valve chamber and the bottom passage is closed. When the piston hitting the nails and before repositing, the high pressure air in the top passage is discharged to make the high pressure air in the middle valve chamber to drive the valve bolt upwardly move to open the main valve opening for guiding the high pressure air in the main air housing into the bottom cylinder chamber via the middle valve chamber and the bottom passage so that the piston is driven to upwardly move. After the piston reposited, the valve bolt moves downwardly to close the main valve opening.

The pneumatic nail gun provides the main passage and the valve bolt to prevent the complexities of conventional air flow passage distribution and valve controlling mechanism. The main passage is simplified to improve the operating facility of the nail gun and lower the cost thereof.

Furthermore, the valve bolt has a small size and a simple structure, which may be made of light material. Then the valve bolt is relatively sensitive to be driven by the high pressure air. Moreover, compressed high pressure air gathered in the top air flow passage drives the valve bolt to close the valve, if the head of the nail gun falls down to the ground, the valve bolt is prevented from shaking or vibrating. The valve bolt has a high position controlling capability.

The pneumatic nail gun includes the head valve integrally formed or disposed on the cylinder. A single air flow communication is utilized to control the timing of moving the head valve upwardly or downwardly. If the head valve is disposed on the cylinder, when the trigger is pressed, the head valve move upwardly together with the cylinder, and when the trigger is released, due to the light weight, the head valve can downwardly move more quickly than the cylinder to close the air communication between the main air housing and the top cylinder chamber to enhance the operation.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
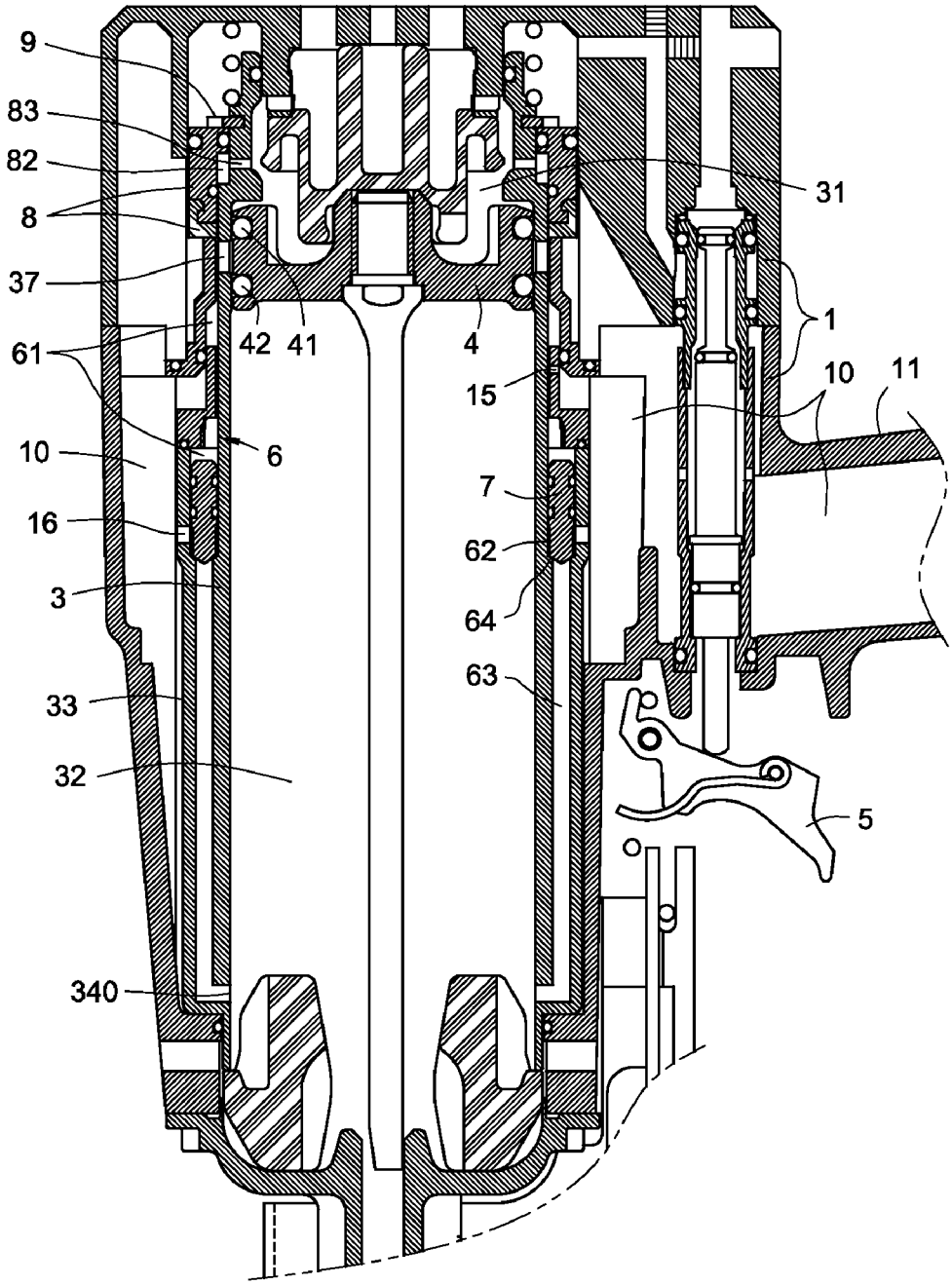
FIG. 1 is a side, cross-sectional view of part of a pneumatical nail gun according to a preferred embodiment of the present invention.

Referring to FIG. 1, a pneumatic nail gun according to a first embodiment of the present invention is shown. The pneumatic nail gun has a gun body 1, a movable cylinder 3 installed in the gun body 1, a head valve 8 integrally formed or disposed on top of the movable cylinder 3, a hitting piston 4 disposed in the movable cylinder 3, a main air housing 10 formed in the nail gun, and at least one main air flow passage 6.

The hitting piston 4 includes at least two air tight rings 41 and 42, which can divide the cylinder 3 into a top cylinder chamber 31 and a bottom cylinder chamber 32 when the hitting piston 4 move downward to hit nails or move upward to reposit.

Figure 5:
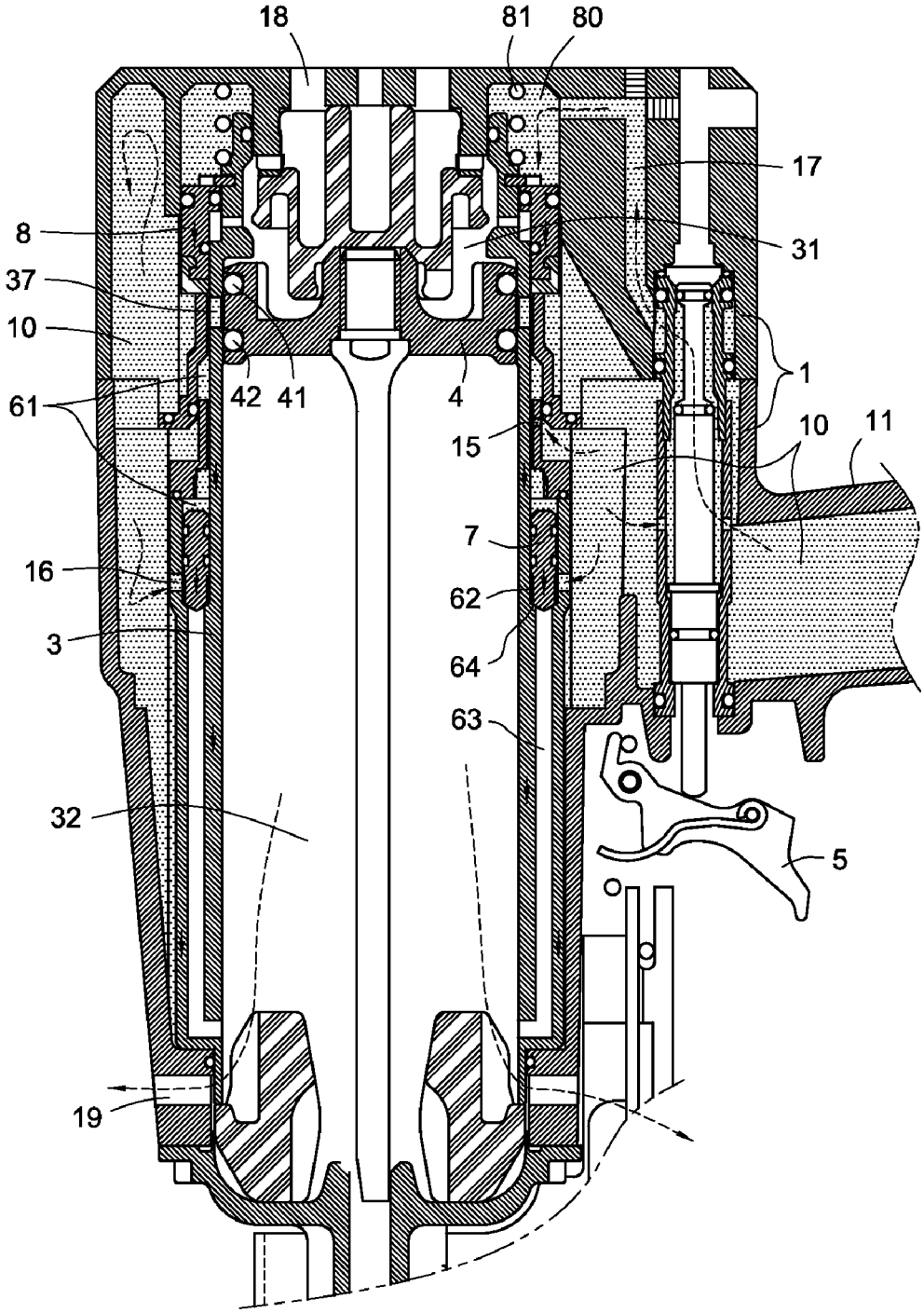
FIG. 5 is a cross-sectional view of the pneumatical nail gun of FIG. 1, showing a state of high pressure air gathered in a gun body before a trigger is pressed.

The main air housing 10 is disposed between a handle 11 of the nail gun and the peripheral portion of the cylinder 3 for continuously gathering high pressure air from air supply via a free end of the handle 11 to maintain a constant air pressure therein (see dots area in FIG. 5). A trigger 5 is disposed at one end of the main air housing 10 for driving the hitting piston 4 downwardly move to hit nails and upwardly move to reposit.

Figure 1A:
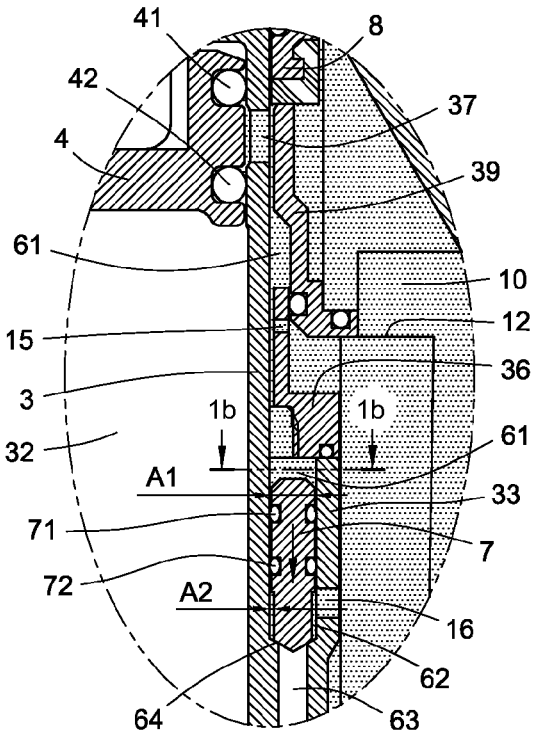
FIGS. 1*a* to 1*f* are enlarged, cross-sectional view of elements of the pneumatical nail gun of FIG. 1, showing the matching relationship therebetween.

There may be a plurality of main air flow passages 6 disposed at a peripheral portion or a side of the cylinder 3, each of which includes a valve bolt 7 (shown in FIG. 1*a*) therein. There are air tight rings 71 and 72 engaged with the valve bolt 7 to divide the main passage 6 into a top passage 61, a middle valve chamber 62, and a bottom passage 63. The top passage 61 is connected with the main air housing 10 via a top through hole 15, the middle valve chamber 62 is connected with the main air housing 10 via a bottom through hole 16 for guiding the high pressure air in the main air housing 10 into the top passage 61 and the middle valve chamber 62. The middle valve chamber 62 is connected with the bottom passage 63 via a main valve opening 64, the valve bolt 7 is capable of opening and closing the main valve opening 64, and the bottom passage 63 is connected to the bottom cylinder chamber 32.

Figure 1B:
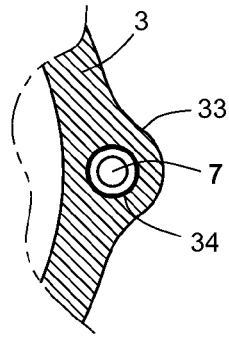
Figure 1C:
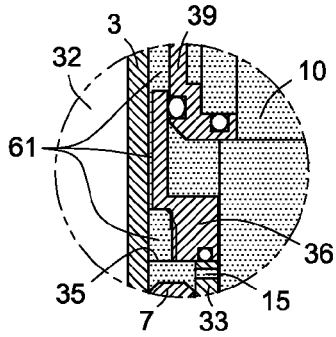
Figure 1E:
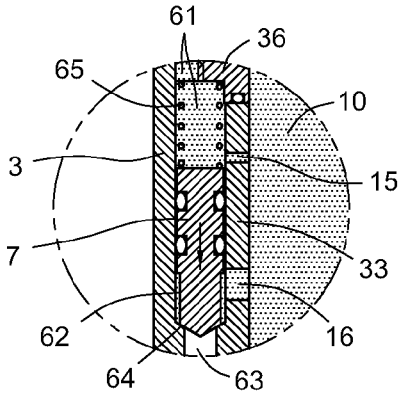
Figure 1D:
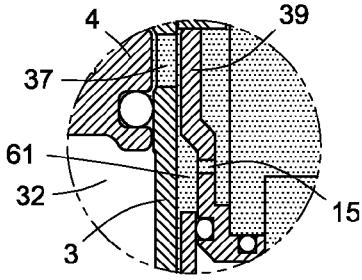

The cylinder 3 further includes at least one ear portion 33 (shown in FIG. 1*b*), the ear portion 33 includes at least one ear hole 34 via an air inlet 340 (shown in FIG. 1) near the bottom of the cylinder 3 to connect with the bottom cylinder chamber 32, and the cylinder 3 further includes a plurality of rib portions 35 (shown in FIG. 1*c*) having locking teeth for fixing a bottom clip ring 36 (shown in FIG. 1*a*) and making the bottom clip ring 36 cover the top of the ear portion 33. In addition, a top clip ring 39 (shown in FIG. 1*a*) is fixed between the head valve 8 and a rib wall 12 of the gun body around the peripheral of the bottom clip ring 36. Accordingly, the main passage 6 may be disposed at a peripheral portion or a side of the cylinder 3 and the position surrounded by the ear portions 33, the bottom clip ring 36, the top clip ring 39 and the bottom of the head valve 8, the top passage 61 may be formed at the position surrounded by the top of the valve bolt 7 installed in the ear hole 34, the bottom clip ring 36, the top clip ring 39 and the bottom of the head valve 8, and the bottom passage 63 may be formed at the position between the bottom of the valve bolt 7 and the air inlet 340. The top through hole 15 may be arranged on one of the bottom clip ring 36, the ear portion 33 (shown in FIG. 1*c*) or the top clip ring 39 (shown in FIG. 1*d*), and the bottom through hole 16 may be arranged at the ear portion 33.

The cylinder 3 further includes at least one top valve hole 37 (shown in FIG. 1*a*) connecting with the top passage 61. The air tight rings 41 and 42 may be used for controlling the opening and closing of the top valve hole 37 so as to control the fluid communication between the top passage 61 and the top cylinder chamber 31. The head valve 8 can thus control the timing of the high pressure air in the main air housing 10 going through the top valve hole 37 to the top cylinder chamber 31 for driving the piston 4 downwardly move to hit the nails.

Figure 2:
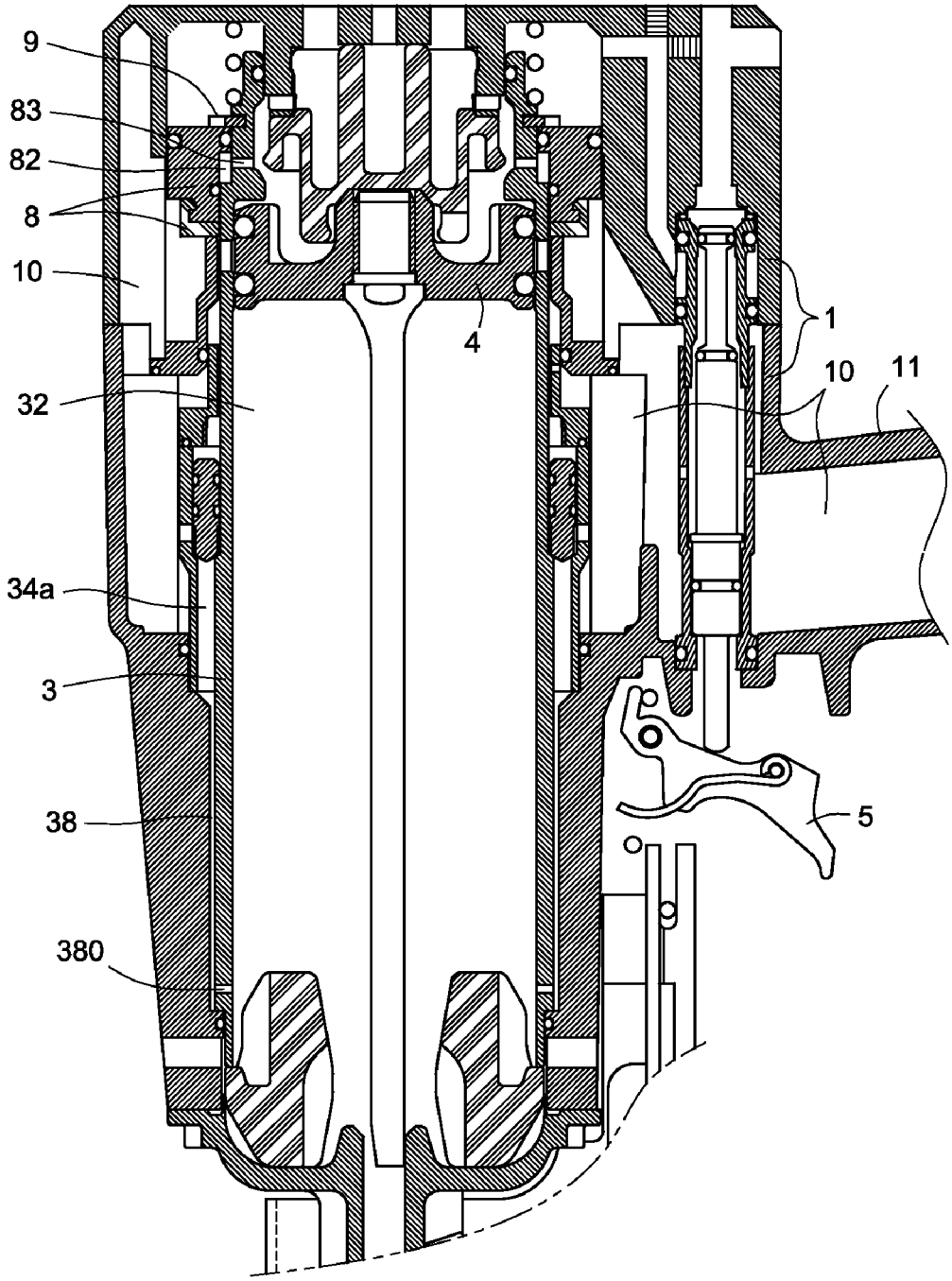
FIG. 2 is an enlarged, cross-sectional view of a pneumatical nail gun according to another preferred embodiment of the present invention.

Another preferred embodiment is shown in FIG. 2, in which the bottom of the ear hole 34*a* is formed in an opening to connect with a lower chamber 38 formed between the inner wall of the gun body 1 and the outer surface of the cylinder 3. A lower air hole 380 is formed near the bottom of the cylinder to connect between the bottom cylinder chamber 32 and the lower chamber 38 so that the bottom passage 63 may be disposed at the position surrounded by the bottom of the valve bolt 7, the lower chamber 38 and the lower air hole 380 to provide the same air guiding operation as mentioned above.

Figure 3:
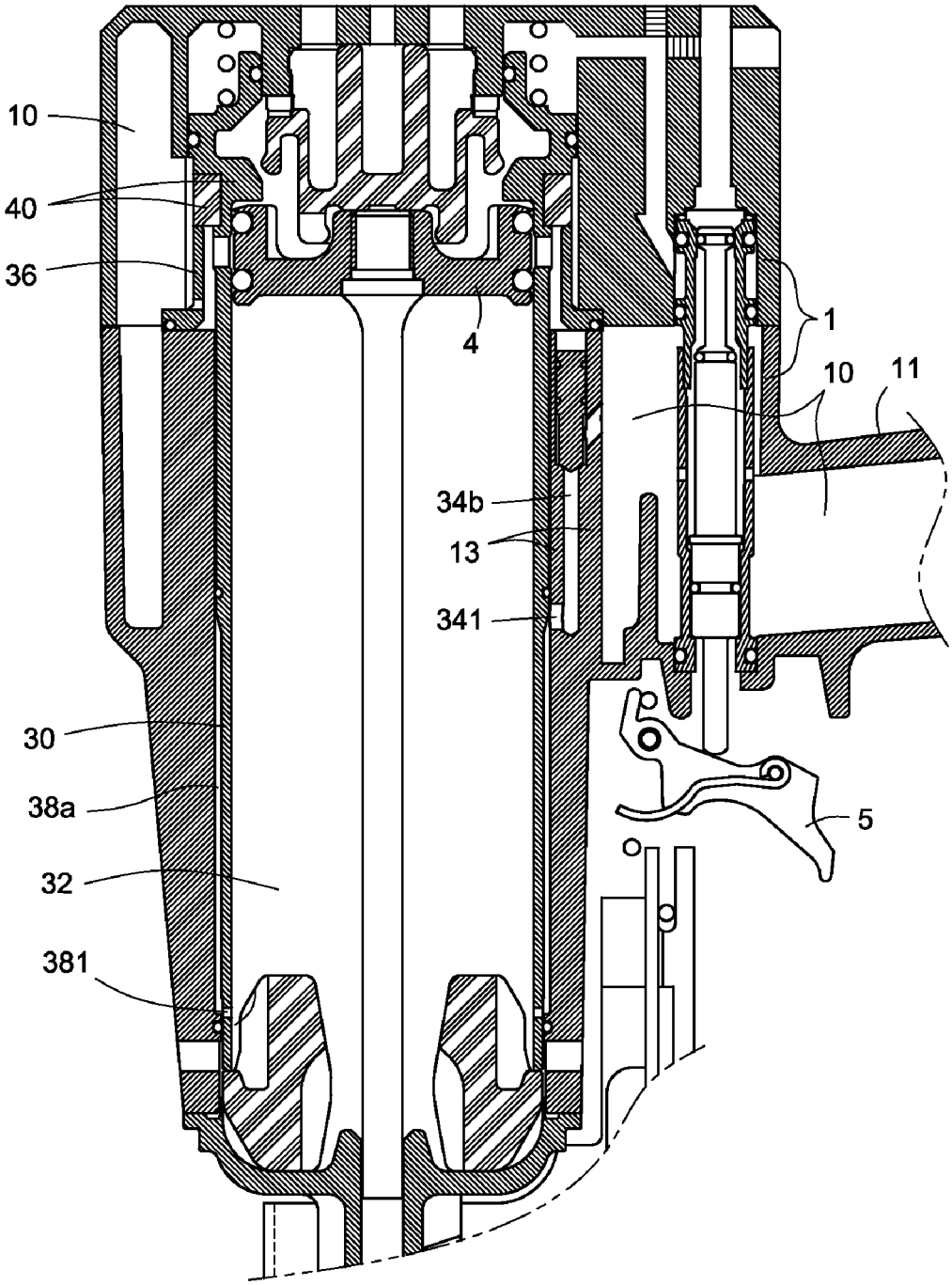
FIG. 3 is an enlarged, cross-sectional view of a pneumatical nail gun according to still another preferred embodiment of the present invention.

Still another preferred embodiment is shown in FIG. 3, in which the ear hole 34*b* is formed in a rib wall 13 of the gun body at a side of the cylinder 30. An air inlet 341 is formed at the bottom of the ear hole 34*b* to connect with a lower chamber 38*a* formed between the inner wall of the gun body 1 and the outer surface of the cylinder 30. A lower air hole 381 is formed near the bottom of the lower chamber 38*a* to connect with the bottom cylinder chamber 32. The bottom clip ring 36 (or the top clip ring 39) is disposed between the top of the rib wall 13 and the bottom of the head valve 40, and the head valve 40 can directly control the opening and closing of the bottom clip ring 36. As such, the top passage 61 may be disposed at the position surrounded by the top of the valve bolt 7, the bottom clip ring 36 and the bottom of the head valve 8, and the bottom passage 63 may be disposed at the position surrounded by the bottom of the valve bolt 7, the lower chamber 38*a* and the lower air hole 381 to provide the same air guiding operation as mentioned above.

Figure 1F:
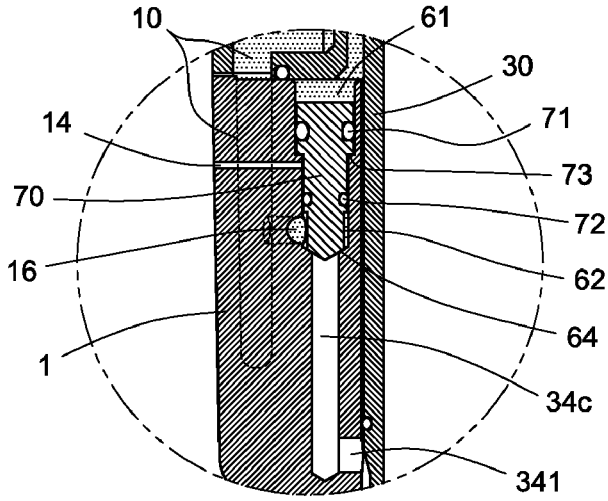

In the other preferred embodiment, as shown in FIG. 1*f*, the ear hole 34*c* is formed in the gun body 1 at a side of the cylinder 30, the valve bolt 70 disposed in the ear hole 34*c* includes a step surface 73, and two air tight rings 71 and 72 are respectively disposed above and below the step surface 73 to be located between the outer wall of the valve bolt 70 and the inner wall of the gun body 1. In addition, an air outlet 14 is formed through the gun body 1 to connect the ear hole 34*c* to the atmosphere at the location between two air tight rings 71 and 72 in order to reduce the high pressure air in the middle valve chamber 62 forced on the valve bolt 70; therefore, when the pressure is accumulated in the top passage 61, the valve bolt can move downwardly to close the main valve opening 64.

In the other preferred embodiment, the air inlet 341 at the bottom of the ear hole 34*b* and the lower chamber 38*a* connected with the air inlet 341 can be omitted to have the ear hole 34*b* extended to connect with the bottom cylinder chamber 32 via the lower air hole 381.

Furthermore, the head valve 40 in FIG. 3 can be integrally formed with the movable cylinder 30 at the top, or individually disposed around the top of the movable cylinder (shown in FIGS. 1 and 2) to have a clip ring 9 disposed between the top of the head valve 8 and the cylinder 3 so that the head valve 8 can upwardly move together with the cylinder 3 through the connection of the clip ring 9. A chamber 82 is formed between the head valve 8 and the cylinder 3, and a through hole 83 connected with the chamber 82 is formed on the cylinder 3 so that air can flow from the chamber 82 through the hole 83 to the top cylinder chamber 31 and flow out through a top exhausting hole 18 (shown in FIG. 5) on the top of the gun body. When the trigger 5 is released (shown in FIG. 8), due to the volume of the head valve 8 is much smaller than the cylinder 3, the head valve 8 is light to downwardly move quicker than the cylinder 3 to close the fluid communication between the main air housing 10 and the top cylinder chamber 31 to enhance the operation.

Figure 4:
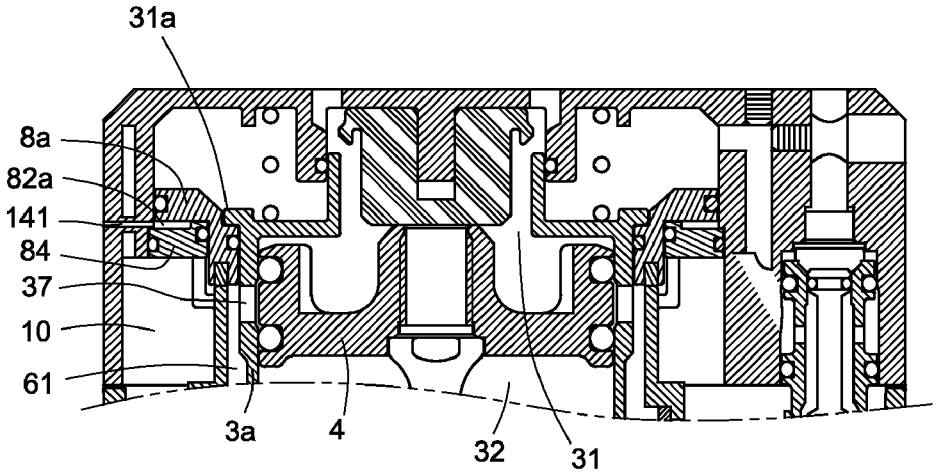
FIG. 4 is an enlarged, cross-sectional view of a pneumatical nail gun having a head valve disposed on the top of the cylinder.

Still in the other preferred embodiment, as shown in FIG. 4, the head valve 8 may be disposed on the movable cylinder 3*a* without the above-mentioned clip ring. A flange 31*a* is formed on the top of the cylinder 3*a* for the head valve 8 pushing the cylinder 3*a* to upwardly move together therewith. Meanwhile, both top surfaces of the head valve 8*a* and the cylinder 3*a* have a larger area for receiving more driving force from the high pressure air. A chamber 82*a* is formed between the head valve 8*a* and a partition ring 84 of the inner wall of the gun body 1, and connects to the atmosphere through an air outlet 141 formed on the side surface near the top of the gun body. Similarly, the head valve 8*a* is light so that can rapidly move downwardly to close the fluid communication between the main air housing 10 and the top cylinder chamber 31 to enhance the operation.

In operation, taking the nail gun of the first embodiment shown in FIG. 1 as an example, before the trigger 5 is manipulated as shown in FIG. 5, compressed air in the main air housing 10 is applied to an upper air chamber 80 through the trigger valve 51 and the trigger passage 17. Therefore, the high pressure air in the upper air chamber 80 and a top spring 81 drive the head valve 8 to close the fluid communication between the top cylinder chamber 31 and the main air housing 10, and the top exhausting hole 18 is opened to make the top cylinder chamber 31 connect with the atmosphere. Meanwhile, cylinder 3 together with the head valve 8 move downwardly to close the fluid communication from the bottom cylinder chamber 32 to the atmosphere via a bottom exhausting hole 19 formed on the bottom of the gun body. On the other hand, the high pressure air in the main air housing 10 may be introduced into the top passage 61 and the middle valve chamber 62 via the top through hole 15 and the bottom through hole 16 (shown in FIG. 1*a*). The portion of the valve bolt 7 disposed in the top passage 61 has a push surface having an area A1, and the portion of the valve bolt 7 disposed in the middle valve chamber 62 has a push surface having an area A2, area A1 is larger than area A2. Therefore, the valve bolt 7 may be induced by the high pressure air in the top passage 61 with a larger pushing force to close the main valve opening 64 so as to close the fluid communication between the middle valve chamber 62 and the bottom passage 63. The hitting piston 4 closes the top valve hole 37 to prevent the high pressure air in the top passage 61 from flowing into the top cylinder chamber 31 or the bottom cylinder chamber 32.

Figure 6:
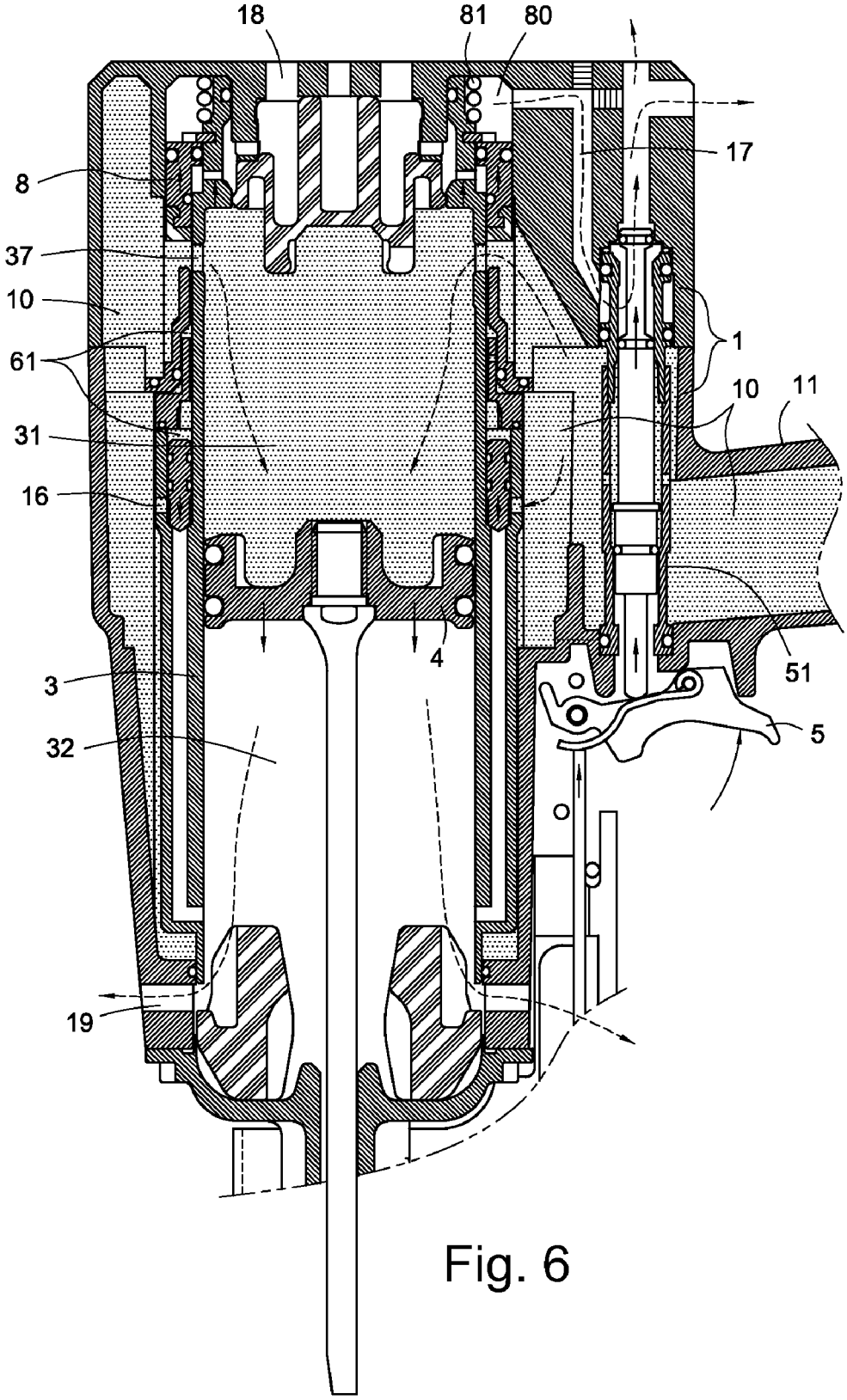
FIG. 6 is a cross-sectional view of the pneumatical nail gun of FIG. 1, showing a state of the high pressure air driving a cylinder upwardly move and then a piston downwardly move to hit nails when a trigger is pressed.
Figure 7:
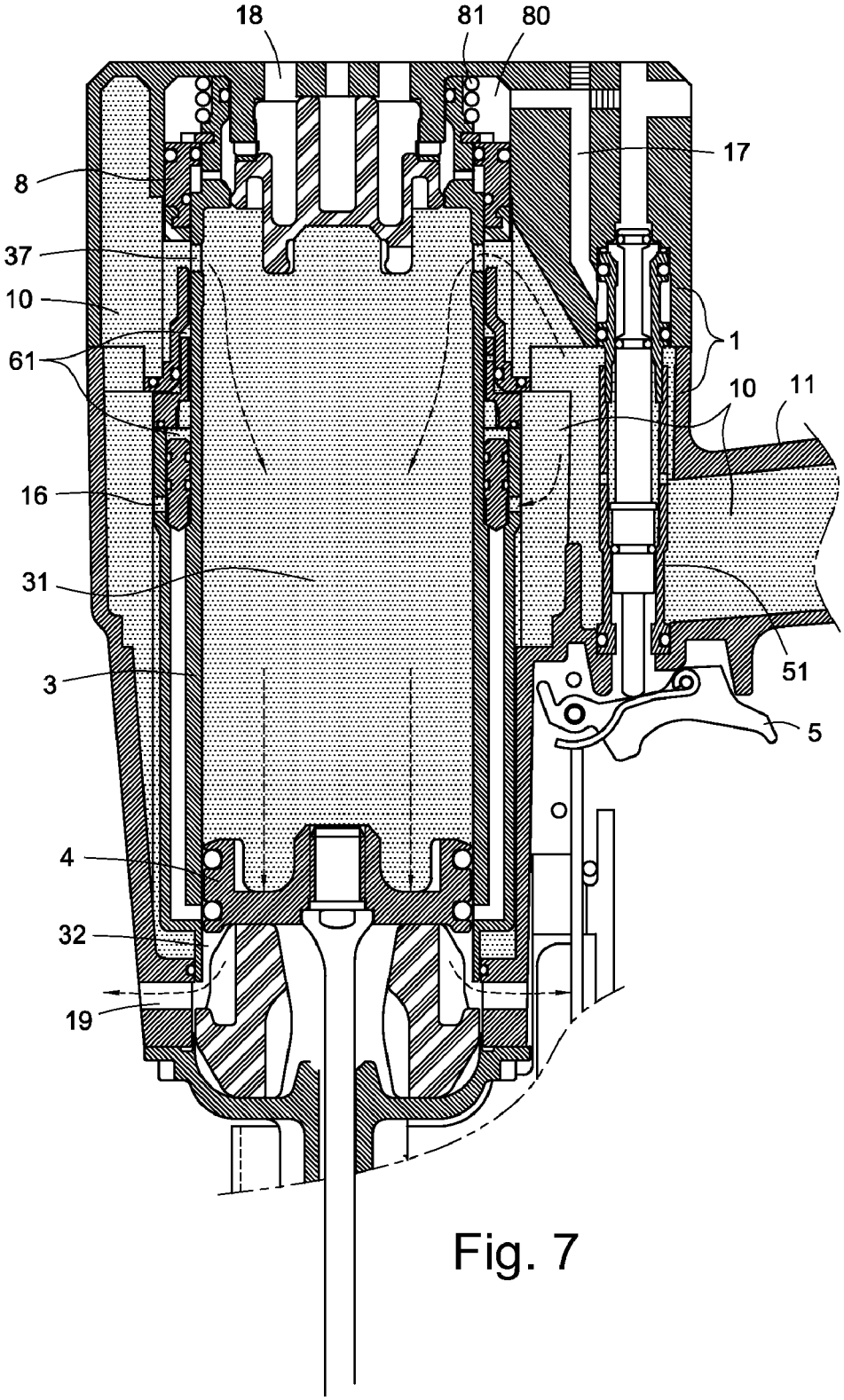
FIG. 7 is cross-sectional view of the pneumatical nail gun of FIG. 6, showing a state of the hitting piston moving to a lower end after the trigger is pressed.

When the trigger 5 is pressed as shown in FIGS. 6 and 7, the trigger valve 51 closes the fluid communication between the main air housing 10 and the trigger passage 17, and the trigger passage 17 is connected to the atmosphere. Compressed high pressure air in the upper chamber 80 is discharged to the atmosphere, so that high pressure air in the main air housing 10 overcomes the force of the top spring 81 to drive the head valve 8 to upwardly move to open the air flow passage of the bottom exhausting hole 19 and close the air flow passage of the top exhausting hole 18, and continuously introduce high pressure air from the main air housing 10 into the top cylinder chamber 31, for driving the hitting piston 4 rapidly downwardly move to hit nails. During the press of hitting nails, the top valve hole 37 is opened and the high pressure air in the top passage 61 is continuously introduced into the top cylinder chamber 31 also.

Figure 8:
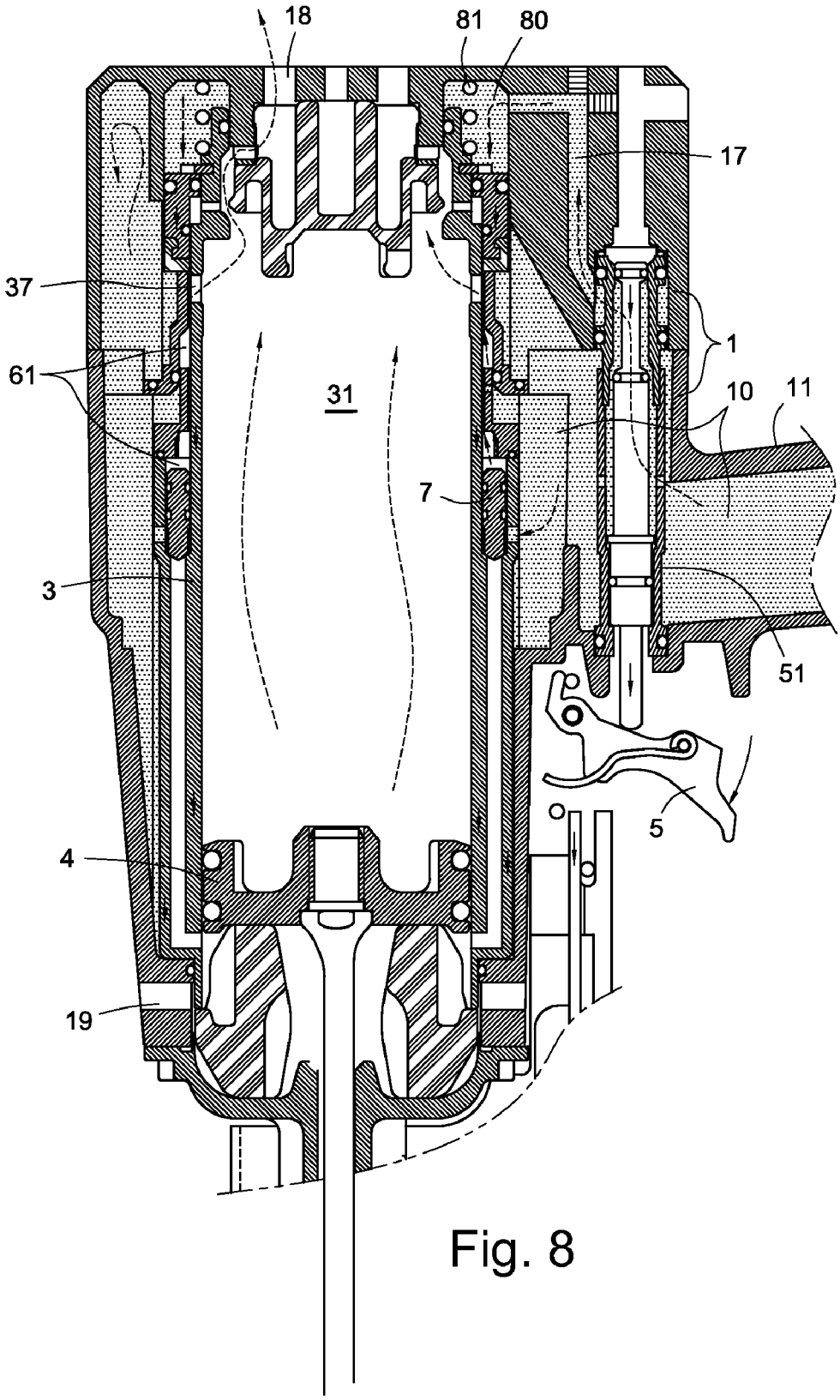
FIG. 8 is a cross-sectional view of the pneumatical nail gun of FIG. 1, showing a state after the trigger is released, the high pressure air drives the cylinder downwardly move.
Figure 9:
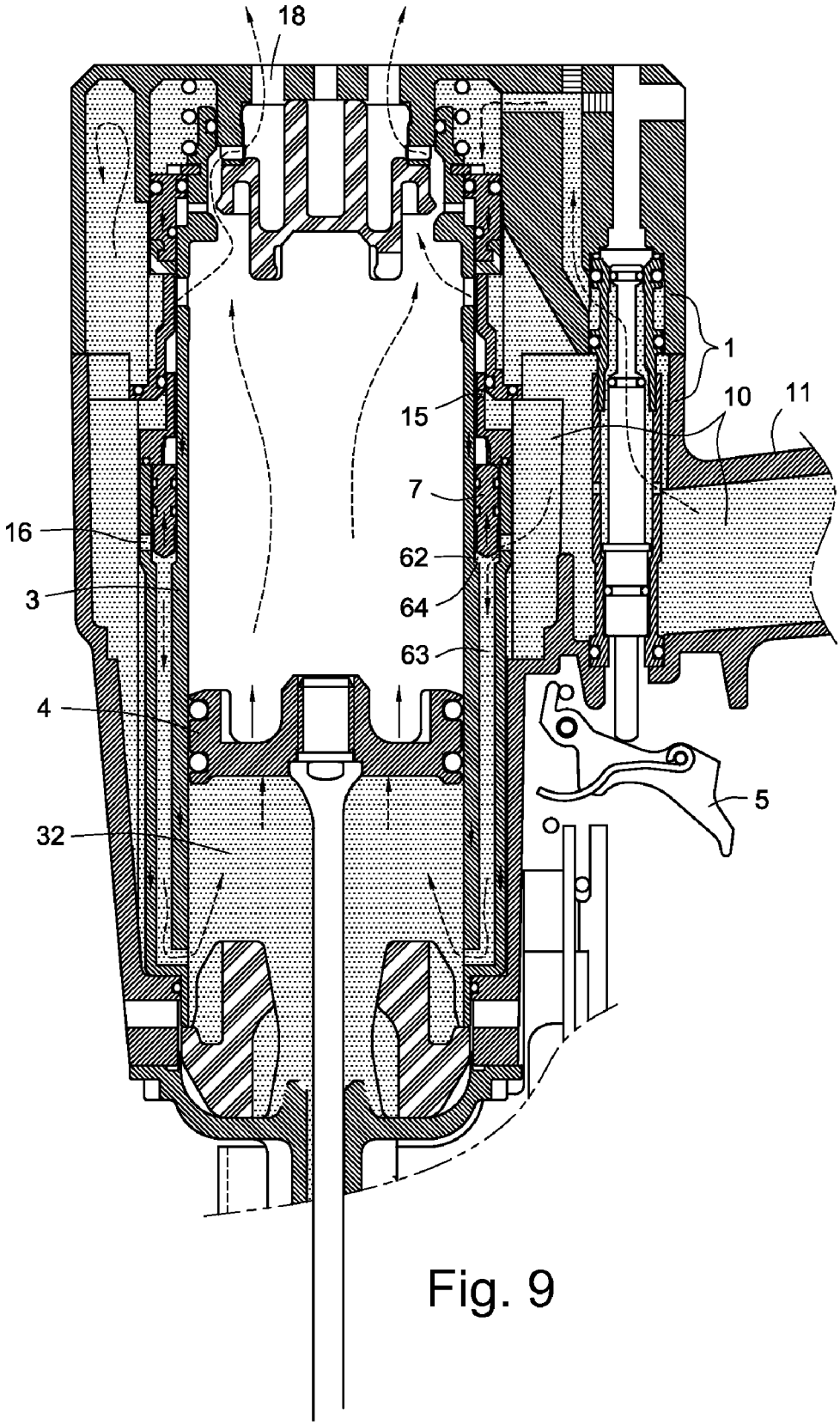
FIG. 9 is cross-sectional view of the pneumatical nail gun of FIG. 6, showing a state after the cylinder moving downwardly, the high pressure air drives a valve bolt open to guide the high pressure air to drive the piston upwardly move.

Then, when the user releases the trigger 5 as shown in FIGS. 8-9, the trigger valve 51 returns to the original open state so that the upper chamber 80 re-collects high-pressure air. The high pressure air and the top spring 81 cooperatively drive the head valve 8, and the cylinder 3 to downwardly move to open the air flow passage of the top exhausting hole 18 and to close the air flow passage of the bottom exhausting hole 19 (shown in FIG. 8). The compressed high pressure air in the top cylinder chamber 31 and the top passage 61 may discharge to atmosphere via the top valve hole 37, the top cylinder chamber 31 and the top exhausting hole 18, then the high pressure air in the middle valve chamber 62 drive the valve bolt 7 to upwardly move to open the main valve opening 64 (shown in FIG. 9). The high pressure air in the main air housing 10 are guided into the bottom cylinder chamber 32 via the middle valve chamber 62 and the bottom passage 63 for rapidly and stably driving the hitting piston 4 upwardly move.

When the hitting piston 4 is reposited (shown in FIG. 5), the top valve hole 37 is closed for continuously guiding the high pressure air in the main air housing 10 to gather into the top passage 61, so as to directly drive the valve bolt 7 downwardly move to close the main valve opening 64. The trigger 5 is reposited, thus a single shot cycle is terminated.

In addition, the top passage 61 may also include a spring 65 (shown in FIG. 1*e*), the pushing force of the spring 65 is smaller than the force of opening the main valve opening 64 by the high pressure air gathering in the middle valve chamber 62. When the high pressure air gathers in the top passage 61, the spring 65 may help to drive the valve bolt 7 to downwardly move for surely closing the main valve opening 64.

Therefore, from above description, it is known that in the above embodiments of the present invention, the pneumatic nail gun utilizes the main passage and valve bolt to continuously guide the compressed high pressure air into the bottom cylinder chamber to realize the stably and rapidly upward movement of the hitting piston. The pneumatic nail gun is facilitated utilization thereof, and it can also save the space inside the nail gun to distribute mechanism as well as has a simple air flow passage distribution to ensure the nail gun having a lower cost. Furthermore, the valve bolt has a small size and a simple structure, which may be made of light material. Then the valve bolt is relatively sensitive to be driven by the high pressure air. The valve bolt has a high position controlling capability.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pneumatic nail gun comprising:

a gun body having a movable cylinder installed therein, a head valve integrally formed or disposed on the top of the cylinder, a hitting piston disposed in the cylinder to divide the cylinder into a top cylinder chamber and a bottom cylinder chamber;

a main air housing accumulating compressed air at a high pressure to drive the hitting piston to downwardly move to hit nails and to upwardly move to reposit;

a main passage formed at a peripheral portion or a side of the movable cylinder, having a valve bolt installed therein to divide the main passage into a top passage, a middle valve chamber, and a bottom passage;

a top through hole connected between the top passage and the main air housing to guide the high pressure air into the top passage for accumulation;

a bottom through hole connected between the middle valve chamber and the main air housing to guide the high pressure air into the middle valve chamber for accumulation; and a main valve opening formed between the middle valve chamber and the bottom passage, to be opened or closed under the controlling of the valve bolt, wherein before the piston hitting the nails, the high pressure air in the top passage drives the valve bolt to downwardly move to close the main valve opening so that air communication between the middle valve chamber and the bottom passage is closed, when the piston hitting the nails and before repositing, the high pressure air in the top passage is discharged to make the high pressure air in the middle valve chamber to drive the valve bolt to upwardly move to open the main valve opening for guiding the high pressure in the main air housing into the bottom cylinder chamber via the middle valve chamber and the bottom passage so that the piston is driven to upwardly move, and after the piston reposited, the valve bolt moves down to close the main valve opening.

2. The pneumatic nail gun as claimed in claim 1, wherein the valve bolt is installed in an ear hole formed in an ear portion disposed on the outer surface of the cylinder, a bottom clip ring is covered on the top of the ear portion, a top clip ring is disposed between under the head valve and a rib wall of the gun body around the peripheral of the bottom clip ring, the top passage is formed at the position surrounded by the top of the valve bolt, the bottom clip ring, the top clip ring and the bottom of the head valve, and the top through hole is arranged on one of the bottom clip ring, the ear portion or the top clip ring.

3. The pneumatic nail gun as claimed in claim 1, wherein the valve bolt is installed in an ear hole formed in a rib wall of the gun body at a side of the cylinder, a bottom clip ring is disposed between the top of the rib wall and the bottom of the head valve, and the top through hole is arranged on the bottom clip ring or the ear portion.

4. The pneumatic nail gun as claimed in claim 1, wherein the valve bolt is installed in an ear hole formed in an ear portion disposed on the outer surface of the cylinder, the ear hole is connected with the bottom cylinder chamber via an air inlet, the bottom passage is formed at the position between the bottom of the valve bolt and the air inlet, and the bottom through hole is arranged at the ear portion.

5. The pneumatic nail gun as claimed in claim 1, wherein the valve bolt is installed in an ear hole formed in a rib wall of the gun body at a side of the cylinder, an air inlet is formed at the bottom of the ear hole to connect with a lower chamber formed between the inner wall of the gun body and the outer surface of the cylinder, a lower air hole is formed near the bottom of the lower chamber to connect with the bottom cylinder chamber, the bottom passage is formed at the position surrounded by the bottom of the valve bolt, the lower chamber and the lower air hole, and the bottom through hole is arranged at the ear portion.

6. The pneumatic nail gun as claimed in claim 1, wherein the valve bolt is installed in an ear hole formed in a rib wall of the gun body at a side of the cylinder, the ear hole is connected with the bottom cylinder chamber via at least one lower air hole, the bottom passage is formed at the position between the bottom of the valve bolt and the lower air hole, and the bottom through hole is arranged at the ear portion.

7. The pneumatic nail gun as claimed in claim 1, wherein the valve bolt is installed in an ear hole formed in the gun body at a side of the cylinder, the valve bolt disposed in the ear hole includes a step surface, two air tight rings and are respectively disposed above and below the step surface to be located between the outer wall of the valve bolt and the inner wall of the gun body, and an air outlet is formed through the gun body to connect the ear hole to atmosphere at a location between two air tight rings.

8. The pneumatic nail gun as claimed in claim 1, wherein the cylinder further comprises at least one top valve hole connecting with the top passage, the top valve hole controls the fluid communication between the top passage and the top cylinder chamber.

9. The pneumatic nail gun as claimed in claim 1, wherein the portion of the valve bolt disposed in the top passage has a surface of a first area, and the portion of the valve bolt disposed in the middle valve chamber has a surface of a second area, the first area is larger than the second area.

10. The pneumatic nail gun as claimed in claim 1, wherein the top passage includes a spring therein abutting the valve bolt to downwardly move to close the main valve opening, the spring has a pushing force smaller than the force of the high pressure air gathering in the bottom passage to drive the valve bolt to upwardly move.

11. The pneumatic nail gun as claimed in claim 1, wherein a clip ring is disposed between the top of the head valve and the cylinder, a chamber is formed between the head valve and the cylinder, and a through hole connected with the chamber is formed on the cylinder so that air flows from the chamber through the through hole to the top cylinder chamber and flow out through a top exhausting hole on the top of the gun body.

12. The pneumatic nail gun as claimed in claim 1, wherein a flange is formed on the top of the cylinder for the head valve pushing the cylinder to upwardly move together therewith, and a chamber is formed between the head valve and the cylinder and connects to atmosphere through an air outlet formed on the side surface near the top of the gun body.

* * * * *